US005224710A

United States Patent [19]

Feokhari

[11] Patent Number: 5,224,710

[45] Date of Patent: Jul. 6, 1993

[54] SOCCER GAME APPARATUS

[76] Inventor: Valery Feokhari, 1675 E. 18th St. #E7, Brooklyn, N.Y. 11229

[21] Appl. No.: 874,438

[22] Filed: Apr. 27, 1992

[51] Int. Cl.[5] ..... A63F 3/00

[52] U.S. Cl. ..... 273/247; 273/146

[58] Field of Search ..... 273/243, 247, 146, 242, 273/244, 277, 85 E, 86 R, 86 A

[56] References Cited

U.S. PATENT DOCUMENTS

| | | | |
|---|---|---|---|
| 593,512 | 11/1897 | Cahalane | 273/247 |
| 5,046,743 | 9/1991 | Salerno | 273/247 |

FOREIGN PATENT DOCUMENTS

| | | | |
|---|---|---|---|
| 2315104 | 10/1974 | Fed. Rep. of Germany | 273/247 |
| 3607209 | 9/1987 | Fed. Rep. of Germany | 273/247 |
| 1021633 | 12/1952 | France | 273/247 |
| 2620947 | 3/1989 | France | 273/247 |
| 195201 | 3/1923 | United Kingdom | 273/247 |
| 249711 | 4/1926 | United Kingdom | 273/247 |
| 651145 | 3/1951 | United Kingdom | 273/247 |
| 1147095 | 4/1969 | United Kingdom | 273/247 |
| 8800853 | 2/1988 | World Int. Prop. O. | 273/247 |

OTHER PUBLICATIONS

"Kick-Off" Advertizement, Camden Products Ltd., Tulsa, Okla. 74101.

*Primary Examiner*—William Stoll

*Attorney, Agent, or Firm*—Leon Gilden

[57] ABSTRACT

A game to simulate soccer with a simulated soccer field having conventional soccer demarcations directed thereabout. Various player positions are imparted permanently on the soccer game field for simulating opposing teams. A twenty-six sided die is provided to afford directed play to various players of each team, with the die having identical enumeration in contrasting colorations for association with the contrasting teams.

3 Claims, 4 Drawing Sheets

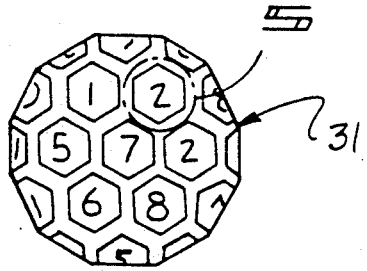
Fig 4
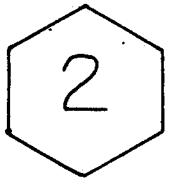
Fig 5
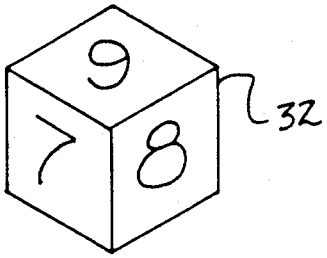
Fig 6
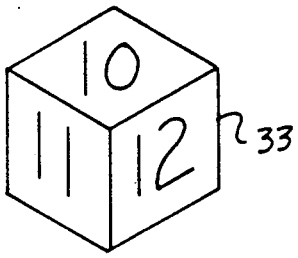
Fig 7
Fig 8
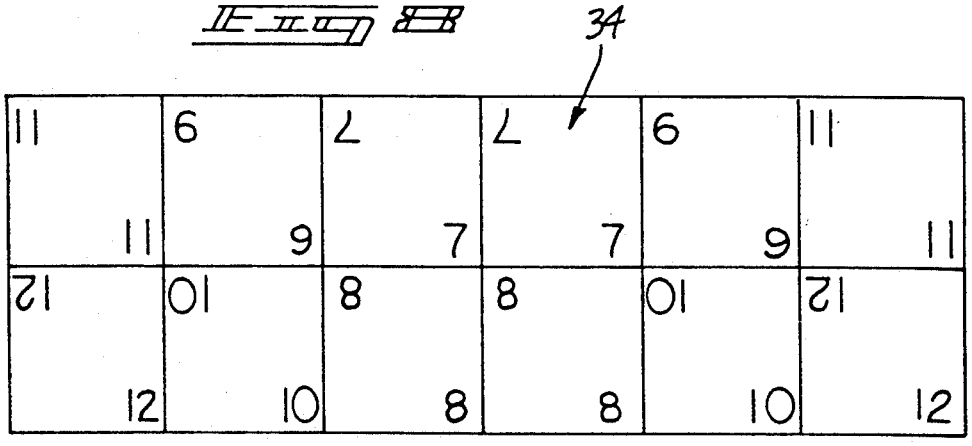

SOCCER GAME APPARATUS

BACKGROUND OF THE INVENTION

1. Field of the Invention

The field of invention relates to soccer game apparatus, and more particularly pertains to a new and improved soccer game apparatus wherein the same is directed to simulating soccer game play.

2. Description of the Prior Art

Soccer game structure of various types have been utilized in the prior art and exemplified in the U.S. Pat. Nos. 4,274,635; 4,372,556; 4,257,599; and 4,350,343. Prior art soccer games and the instant invention are directed to stimulating play and interest in soccer game construction and enjoyment.

The instant invention attempts to overcome deficiencies of the prior art by setting forth a game structure directed to the rapid play to more readily simulate a rapidly moving soccer game.

Accordingly, there continues to be a need for a new and improved soccer game apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of soccer game apparatus now present in the prior art, the present invention provides a soccer game apparatus wherein the same is directed to simulating soccer game play. As such, the general purpose of the present invention, which will be described subsequently in greater detail, is to provide a new and improved soccer game apparatus which has all the advantages of the prior art soccer game apparatus and none of the disadvantages.

To attain this, the present invention provides a game to simulate soccer play, with a simulated soccer field having conventional soccer demarcations directed thereabout. Various player positions are imparted permanently on the soccer game field for simulating opposing teams. A twenty-six sided die is provided to afford directed play to various players of each team, with the die having identical enumeration in contrasting colorations for association with the contrasting teams.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved soccer game apparatus which has all the advantages of the prior art soccer game apparatus and none of the disadvantages.

It is another object of the present invention to provide a new and improved soccer game apparatus which may be easily and efficiently manufactured and marketed.

It is a further object of the present invention to provide a new and improved soccer game apparatus which is of a durable and reliable construction.

An even further object of the present invention is to provide a new and improved soccer game apparatus which is susceptible of a low cost of manufacture with regard to both materials and labor, and which accordingly is then susceptible of low prices of sale to the consuming public, thereby making such soccer game apparatus economically available to the buying public.

Still yet another object of the present invention is to provide a new and improved soccer game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an orthographic view of the game die utilized by the invention.

FIG. 6 is an isometric illustration of a scoring die utilized by the invention.

FIG. 7 is an isometric illustration of a goalie die utilized by the invention.

FIG. 8 is an orthographic top view of a scoring plate at opposed ends of the game board.

FIG. 9 is an isometric illustration of a die rolling member as utilized optionally by the invention.

DESCRIPTION OF THE PREFERRED EMBODIMENT

Figure 1:
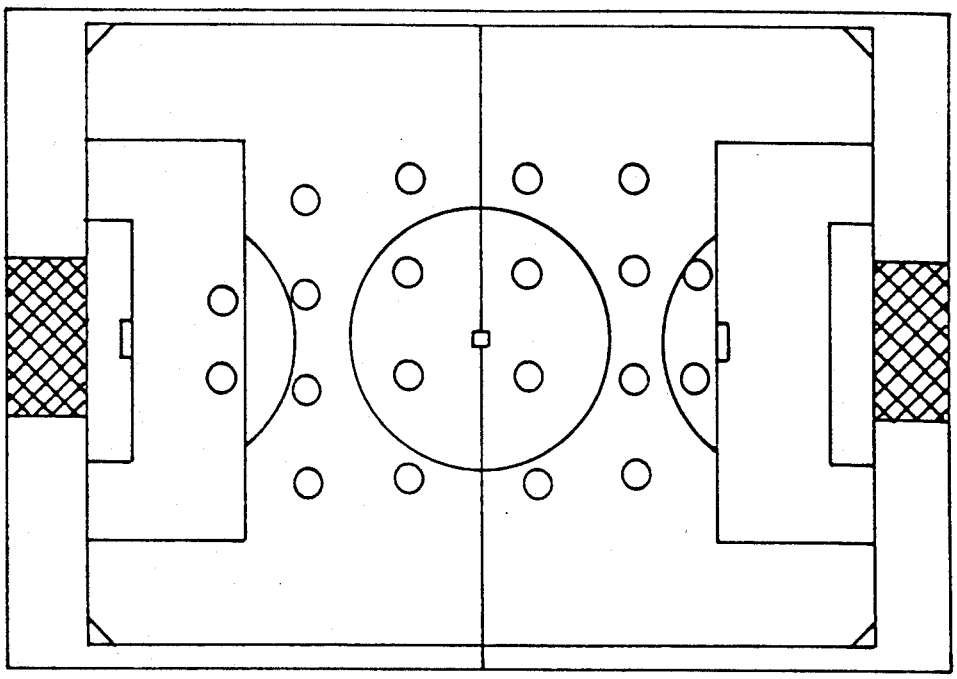
FIG 1 PRIOR ART
FIG. 1 is an orthographic top view of a prior art soccer game board organization.

With reference now to the drawings, and in particular to FIGS. 1 to 9 thereof, a new and improved soccer game apparatus embodying the principles and concepts of the present invention and generally designated by the reference numerals 11-53 will be described.

Figure 2:
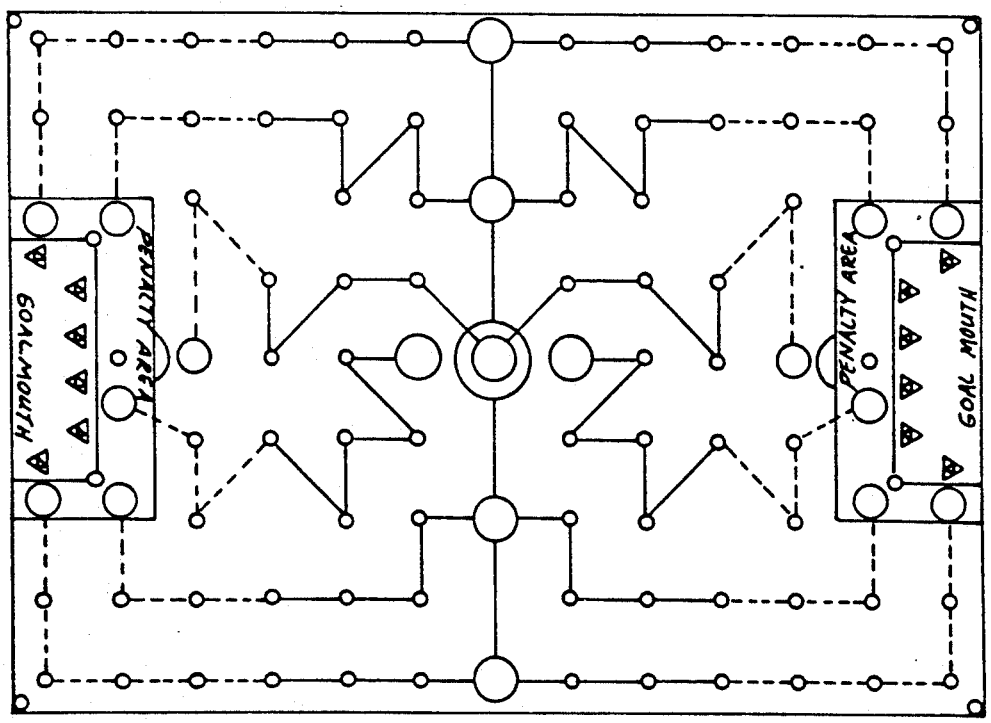
FIG 2 PRIOR ART
FIG. 2 is an orthographic top view of a further example of a prior art soccer game board organization.

The FIGS. 1 and 2 illustrate respective prior art soccer game board layouts, as set forth in the U.S. Pat. Nos. 4,257,599 and 4,350,343 respectively. The game boards of the prior art are typically of an organization to simulate a soccer game field.

Figure 3:
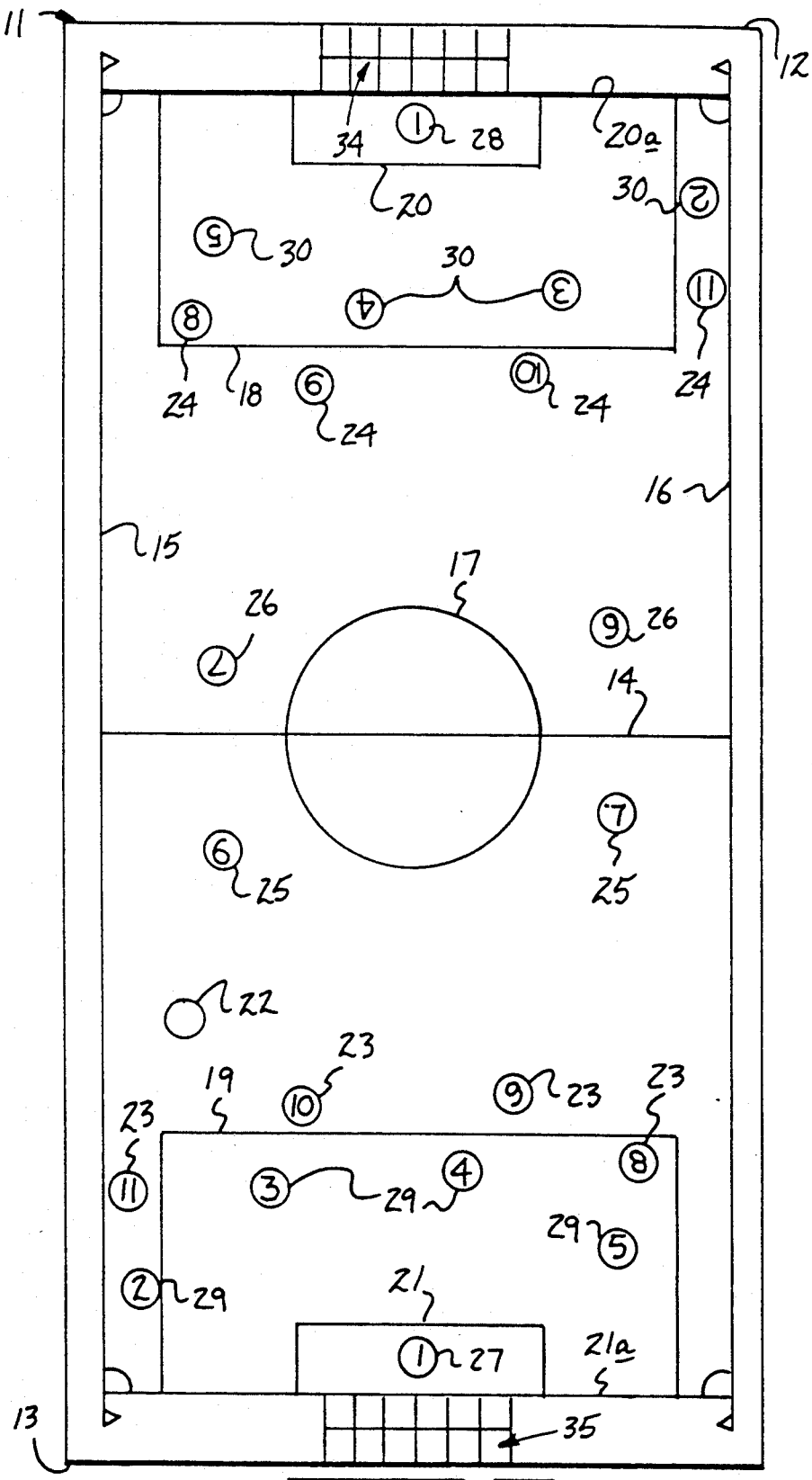
FIG. 3 is an orthographic top view of the game board structure of the instant invention.
Figure 5:
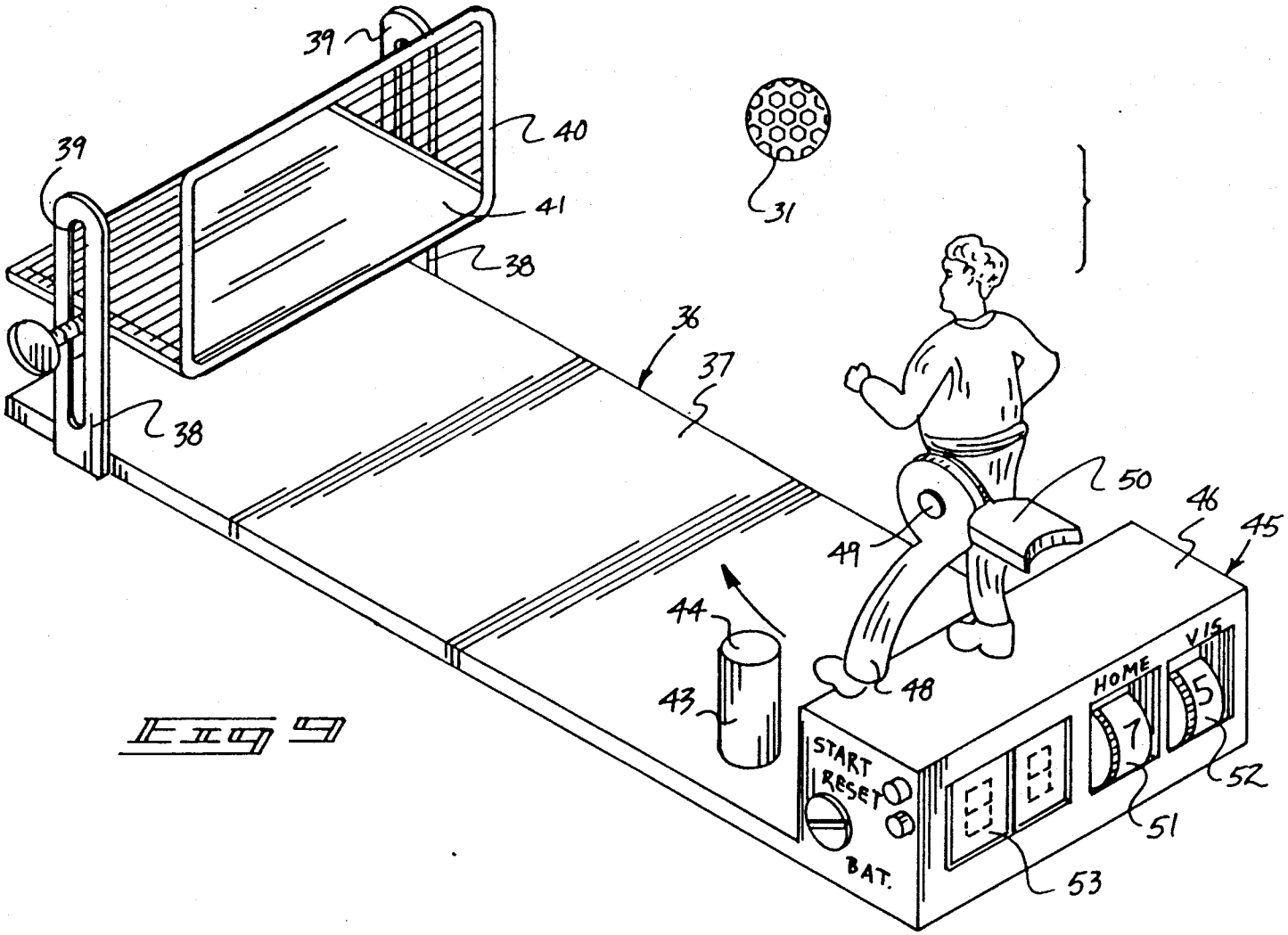
FIG. 5 is an orthographic view of section 5, as set forth in FIG. 4, illustrating configuration of a single space of the game die.

More specifically, the soccer game apparatus of the instant invention essentially comprises a game incorporating international soccer rules, as well as a game board 11, as illustrated in the FIG. 3.

The game board 11 includes a first board end 12 spaced from a second board end 13 having a game field therebetween having a field divider line 14, first and second side lines 15 and 16, a central field circle 17, first and second defensive lines 18 and 19 extending forwardly of respective first and second back lines 20*a* and 21*a* at opposed ends of the simulated field, with respective first and second goal lines 20 and 21 within the respective first and second defensive lines 18 and 19. The field demarcations are consistent with conventional soccer game field configuration, such as illustrated in the prior art by FIG. 1. The organization utilizes a game ball or token ball or disc structure 22 for indicating orientation of the game ball play throughout utilization of the game structure.

Respective second and first team forward positions 23 and 24 each incorporating opposing respective demarcated and enumerated circles 8-11 inclusively are forwarded on opposed sides of the field divider line 14. Second and first mid field positions 25 and 26 having opposed enumerated circles 6 and 7 are positioned on opposed sides of the field divider line 14 adjacent the field divider line. Second and first goalie positions 27 and 28 are positioned between the respective first and second goal lines 20 and 21 forwardly of the first and second back lines 20*a* and 21*a* dictated by the opposing enumeration 1 encircled as illustrated in FIG. 3. Respective second and first defense positions, including the encircled enumerations 2, 3, 4, and 5, are indicated by the designations 29 and 30 respectively on opposed sides of the field divider line 14 rearwardly of the respective first and second defensive lines 18 and 19.

With reference to FIG. 4 illustrates the twenty-six sided game die 31 utilized by the invention. The game die includes twenty-six spaces, with units of thirteen spaces of contrasting colorations. Each unit includes the enumerations 1-12 and the letter "F" respectively. The contrasting colorations are arranged to designate opposing teams on opposed sides of the divider line 14. A scoring die 32 having the designations 7-12 is provided, as well as a companion goalie die 33 having the enumerations 7-12 therewithin. First and second numerical scoring plates 34 and 35 are imparted onto the game board 11 immediately and rearwardly of the respective first and second back lines 20*a* and 21*a* having the designations 7-12 inclusively imparted thereon in association with the scoring and goalie dies 32 and 33.

In play of the game, the first or second team designated arbitrarily on opposed sides of the divider line 14 may be directed to initiate play by throw of a coin and the like or by consensus between the opposing teams. A moving team may thereby roll the game die 31. The game die 31, as noted above, is of a first and second coloration having the numbers 1-12 and a designation "F" associated with each of the first and second teams. For example, upon the game die being rolled and the enumeration on top is a first coloration 9, the token ball or disc 22 is in possession of the first team's defender with the enumeration 9. As the forwards of each team have the enumeration 8-11 inclusively, they may either pass the ball to other players or try to make a goal if the number on the game die has the first coloration and the numbers 7-12 directed in a subsequent roll. As the mid fielders have the numbers 6 and 7, they may try to make a goal if they can obtain a number 7 or 8 on the game die. Defenders have the enumeration 2-5 and may only attempt to direct the ball into an opposing net if the game die has been subsequently rolled and their color and the number 7-12 is directed. If the number 12 appears with the moving players' coloration, they may pass the ball to any other player. If the number 12 of the opposing team's coloration appears on the game die on a roll, the moving players may direct the token ball 22 out of the side line adjacent a net to require the other team to make a corner kick, or the mid fielders 6 and 7 may direct the ball out of the side line and the opposing team throws the game die 31. The forwards 8-11 may direct the ball into the net but upon missing, the goal keeper throws the dice. On a corner kick, the ball is placed on the corner of the field and after the game dice 31 is rolled, the game or token ball 22 is directed to a player with that number and the coloration to appear on the topmost portion of the game die member or dice 31. If the dice shows 12 and the color of the team has attempted the corner kick, the ball is directed into the twelfth square of the scoring plate of the goal receiving the kick. If the dice shows a 12 with the opposing teams' coloration, then the ball gets hit into the outside and the opposing teams' goal keeper gets the ball. If after the game dice is rolled and it shows a number and the color of the opposite team, the player who has the ball at the time has two choices of play, with one, either giving the ball to a person with the number and the coloration as it appears on the dice member 31, or giving it to the closest player of the opposing team. For example, if the ball is in possession of a first teams' player with the number 6, after the game dice is rolled and a block 11 is to appear, then the first teams' player has more to gain if he directs the ball to a closest opposite player which would be the opposite player's 7 on the field or board 11.

The goal of each team has twelve squares in the storing plates 34 and 35, with the squares enumerated 7-12. In these squares is where the player directs the ball or disc 22 to attempt a goal. The goal keeper 1 can keep the ball and prevent a goal. It is for that reason that a goalie dice 33 is provided with the numbers 7-12 thereon. In this manner, a directed hit onto the goal and the square 9 is directed by a moving team, the goal keeper 27 designated by the enumeration 1, rolls his die member 33 and if the die 33 shows an enumeration greater than 9, the score is blocked. The goal keeper may then direct the ball into the field by rolling the soccer ball or game die member 31. If the goalie's moving dice 33 indicates an enumeration less than 9, the moving team has scored a goal.

If the game die indicates the letter "F" with the coloration of the moving team, the ball is directed to a closest player of the opposite team and play continues. If the die member indicates the letter "F" with the opposing team's coloration, the ball stays with the player who had the ball and play continues.

If the opposing team has a player obtaining the letter "F" or foul three times, the other team gets to make a penalty shot into the opposing team's net.

To make a penalty shot, a team has to make the shot and the goal keeper 27 or 28 roll opposing dice 32 and 33. If the team making the penalty shot gets a larger number than the goalie's number obtained by the goalie dice 33, that means that the goal has been made and clearly the opposite is true.

It may be understood that the disc 22 may be directed manually into the opposing team's goal area onto the opposing team's scoring plates 34 and 35 by means of scoring goals from various players about the field.

The FIG. 9 illustrates an optional construction of rolling the game die 31, wherein the die rolling member 36 is formed with a base plate 37 having spaced support legs 38 arranged in a parallel coextensive relationship at a forward distal end of the base plate 37 on opposed sides thereof. The support legs 38 have support leg slots 39 directed therethrough in a parallel and coextensive relationship mounting a receiving cage 40 therebetween. The receiving cage has a receiving cage floor 41, with the floor including a plurality of cage mounting fasteners 42 directed into opposed ends of the floor, with a fastener directed through an individual slot 39 to permit vertical positioning of the cage relative to the base plate 37.

A support boss 43 positioned adjacent an opposite end of the base plate has a concave upper end face 44 initially mounting the game die 31.

A scoring housing 45 is provide and extends upwardly of the base plate adjacent an opposed end relative to the cage, with the housing having a top wall 46. A support member 47 is fixedly mounted to the top wall, with the support member including a kick lever 48 pivotally mounted thereto about a kick lever pivot 49. A kick lever impact plate 50 positioned above the kick lever pivot 49 is provided, whereupon the game ball being positioned upon the concave face 44 is subject to impact by the kick lever 48 or a lower distal end thereof upon impact of the impact plate 50 manually to attempt to direct the game die into the cage 41. It should be noted in this manner that a moving team not directing the game die into the cage merely loses a turn and the opposing player takes a turn to add an element of chance and risk into play of the game.

The housing 45 may be further provided with respective first and second rotary wheels 51 and 52 of various enumerations to accommodate various scoring totals by opposing teams. A timer mechanism 53 is further provided having associated start and reset buttons, as well as removable battery within the housing to provide electrical energy for use of the timer mechanism 53.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A soccer game apparatus, comprising, a game board, the game board having a representative soccer field imparted thereon, including a first side line spaced from and parallel to a second side line, with a field divider line orthogonally and medially directed between the first side line and the second side line, and a first back line and a second back line arranged in a parallel coextensive relationship at opposed ends of the first and second side lines, with the first goal lines and the second goal lines intersecting the respective first and second back lines extending onto the game board, and a first enumerated scoring plate and a second enumerated scoring plate on the game board in contiguous communication to the first and second back lines rearwardly of the respective first and second goal lines, and first team designations positioned on the game board on a first side of the divider line forwardly of the first back line, and second team designations imparted on the game board between the divider line and the second back line, and the first and second scoring plate having a number of various predetermined designations imparted thereon, and a scoring die and a goalie die, with each of said scoring die and goalie die having an equivalent number of said predetermined designations thereon, and a twenty-six sided game die of generally spherical construction, with the twenty-six sided game die having thirteen predetermined designations of a first coloration, and thirteen designations of a second coloration associated with first and second teams on opposed sides of the divider line to direct play of the first and second teams, with a token game disc adapted for free and manual directing about the game board.

2. An apparatus as set forth in claim 1 including a game die rolling member, the game die rolling member having a base plate, with the base plate including spaced support legs mounted to opposed sides of the base plate extending upwardly thereof in a parallel coextensive relationship, with each support leg having a support leg slot, and a receiving cage mounted between the support legs, with the receiving cage having a cage floor, the cage floor having cage mounting fastener directed through a support leg slot of each support leg directed into the cage floor, and a support boss fixedly and orthogonally mounted to the base plate spaced from the cage, with the support boss having a concave upper face for receiving the game die thereon, and a scoring housing, with the scoring housing having a top wall, and a support member fixedly mounted to the top wall, the support member having a kick lever, with the kick lever including a kick lever pivot pivotally mounting the kick lever to the support member, and an impact plate mounted to the kick lever above the kick lever pivot, with the kick lever having a kick lever lower distal end positioned in adjacency relative to the support boss upper end face, whereupon impact of the impact plate directs the kick lever lower distal end to impact the game die for projection into the cage.

3. An apparatus as set forth in claim 2 wherein the housing includes a first rotary scoring wheel and a second scoring wheel having sequential enumerated designations thereon for maintaining scoring of the first and second team, and a timer mechanism mounted within the housing.

* * * * *